US007280088B2

(12) United States Patent
Nicolas et al.

(10) Patent No.: US 7,280,088 B2
(45) Date of Patent: Oct. 9, 2007

(54) METHOD AND DEVICE FOR CONTROLLING A MATRIX ELECTRON SOURCE, WITH REGULATION BY THE EMITTED CHARGE

(75) Inventors: Pierre Nicolas, St Egreve (FR); Denis Sarrasin, Sassenage (FR)

(73) Assignee: Commissariat a l'Energie Atomique, Paris (FR)

( * ) Notice: Subject to any disclaimer, the term of this patent is extended or adjusted under 35 U.S.C. 154(b) by 165 days.

(21) Appl. No.: 10/332,883

(22) PCT Filed: Jul. 12, 2001

(86) PCT No.: PCT/FR01/02276

§ 371 (c)(1),
(2), (4) Date: Jan. 13, 2003

(87) PCT Pub. No.: WO02/07139

PCT Pub. Date: Jan. 24, 2002

(65) Prior Publication Data

US 2004/0021623 A1 Feb. 5, 2004

(30) Foreign Application Priority Data

Jul. 13, 2000 (FR) ..... 00 09194

(51) Int. Cl.
*G09G 3/22* (2006.01)

(52) U.S. Cl. ..... 345/74; 345/77; 345/78; 345/89; 345/101; 345/75

(58) Field of Classification Search ..... 345/74.1, 345/76–77, 204, 208, 211, 75.2
See application file for complete search history.

(56) References Cited

U.S. PATENT DOCUMENTS 5,138,308 A * 8/1992 Clerc et al. ..... 345/75.2
5,359,256 A 10/1994 Gray ..... 313/169
6,020,864 A * 2/2000 Bancal ..... 345/74.1
6,169,528 B1 * 1/2001 Oguchi et al. ..... 345/74.1

(Continued)

OTHER PUBLICATIONS

Baptist, R., "Ecrans Fluorescents à Micropointes", Nov.-Dec. 1991, L'Onde Electrique, vol. 71, No. 6, pp. 36-42.

(Continued)

*Primary Examiner*—Richard Hjerpe
*Assistant Examiner*—Leonid Shapiro
(74) *Attorney, Agent, or Firm*—Thelen Reid Brown Raysman & Steiner LLP

(57) ABSTRACT

Process and device for control of an electron source with matrix structure, regulated by the emitted charge.

The invention is applicable to an electron source comprising addressing rows and columns which intersect to define emission areas, the electrons being supplied by the columns. According to this invention, the emission of electrons is triggered by increasing the potential of the columns to a value that will enable preferential emission of unaddressed rows. Then, throughout the emission duration, the potential of columns will be kept equal to this value, while simultaneously making measurements in the columns of the quantity of charges emitted by the pixels in the said columns. Secondly, when the quantity of charges measured on a column reaches a required charge quantity, the potential of this column is switched to a value that will block the emission of electrons.

The invention is particularly applicable to flat field emission displays.

6 Claims, 10 Drawing Sheets

U.S. PATENT DOCUMENTS

| | | | | |
|---|---|---|---|---|
| 6,204,834 | B1 * | 3/2001 | Baker et al. | 345/75.2 |
| 6,411,269 | B1 * | 6/2002 | Zimlich | 345/75.2 |
| 6,445,367 | B1 * | 9/2002 | Suzuki et al. | 345/75.2 |
| 6,465,966 | B2 * | 10/2002 | Konuma | 315/169.1 |

OTHER PUBLICATIONS

Leroux et al., "21.1: Microtips Displays Addressing", 1991, SIE Digest, pp. 437-439.

Sakai et al., "18.3L: Flat Panel Displays Based on Surface-Conduction Electron Emitters", 1996, Euro Display, pp. 569-572.

Temple, Dorota, "Recent Progress in Field Emitter Array Development for High Performance Applications", Jan. 25, 1999, Materials Science and Engineering, R24, No. 5.

Uemura et al., "39.3: Carbon Nanotube FED Elements", 1998, SID Digest, pp. 1052-1055.

* cited by examiner

METHOD AND DEVICE FOR CONTROLLING A MATRIX ELECTRON SOURCE, WITH REGULATION BY THE EMITTED CHARGE

CROSS-REFERENCE TO RELATED APPLICATION

This application claims priority based on French Patent Application Ser. No. 00 09194, filed on Jul. 13, 2000.

TECHNICAL FIELD

This invention relates to a process and device for control of an electron source with matrix structure.

Various electron sources or electron emitter devices are known. These known devices are based on physical principles that may be very different from each other.

For example, there are hot cathodes, photo emissive cathodes and field effect microtip cathodes (see document [1] which is mentioned at the end of this description like the other documents mentioned in the following), field effect nanocrack devices (see document [2]), graphite or diamond carbon type plane electron sources (see document [3]) and devices called LEDs.

Such electron source are used mainly for display applications with flat screens, but also for other domains, for example physical instrumentation, lasers and X-ray emission sources (see documents [4]). The examples of the invention that will be given in the following are limited to display applications, which is the largest application (and includes flat screens).

However, this invention is not limited to this field and is applicable to any device that uses one or more electron sources (and includes the case of a 1 row×1 column matrix), which for example is the case for a single pixel screen in pulsed operation.

FIG. 1 diagrammatically illustrates the operating principle for a display screen that uses a field emission electron source 2.

The screen in FIG. 1 also comprises an anode 4 comprising an anode conductor 6.

The cathode that forms the electron source 2 is usually voltage controlled. It emits an electron flux 8 under the influence of this voltage.

Consider the special case of a field emission display that is diagrammatically and partially shown in perspective in FIG. 2. This screen comprises a cathode comprising a substrate 10, equipped with cathode conductors 12 on which microtips 14 are formed, and grids 16 formed above the cathode conductors and provided with holes 18 facing the microtips. The screen also comprises an anode comprising a substrate 20 and an anode conductor 22 facing grids 16.

Returning to FIG. 1, the voltage source 24 used to apply the high voltage Va to the anode conductor 6 can be seen. The polarization means 26 that will be used to apply the voltage Vg to the grid of the electron source 2 and the voltage Vc to the cathode of this source, can also be seen. The control voltage equal to Vg−Vc is denoted Vgc. The characteristics of the cathode Icath=f(Vgc) are shown in FIG. 3 (curves I and II). The threshold voltage is denoted Vth. For a control voltage Vo greater than Vth, the curve I corresponds to a cathode current Io, while curve II corresponds to a current Io−ΔI.

Electrons emitted by the electron source are accelerated and collected by the anode subjected to the high voltage $V_a$.

If a layer of phosphor material 28 is deposited on the anode conductor 6, then the kinetic energy of the electrons is converted to light.

It is possible to obtain a display screen by organizing the basic structure of FIG. 1 in the form of a matrix structure. This matrix structure must enable addressing of each pixel on the screen and therefore control of the brightness of the pixel considered (see document [5]).

A matrix structure screen using an electron source with a matrix structure 30 is diagrammatically shown in FIG. 4. Each pixel in the electron source 30 is defined by the intersection of a row electrode and a column electrode on this source. The row electrodes of this source are denoted L1, L2 . . . Li . . . Ln and the column electrodes of this source are denoted C1, C2 . . . Cj . . . Cm. The screen in FIG. 4 comprises a row scanning generator 34. This generator is provided with a voltage source 36 with voltage Vlns and a voltage source 38 with voltage Vls. The control voltage of row Li is denoted Vli. The screen is also provided with means 40 of generating column control voltages. The control voltage of column Cj is denoted Vcj.

More precisely, a control circuit is assigned to each row and to each column on the screen and addressing is done one row at a time for a time $t_{lig}$. Row potentials are then increased to $V_{ls}$ which is the called row selection voltage in sequence, while the potential of columns is increased to a potential corresponding to the information to be displayed. During this time $t_{lig}$, unselected rows are increased to a potential $V_{lns}$ such that the voltages present on the columns do not affect the display on these rows. The value $V_{li}-V_{cj}$ or the duration $t_{com}$ of control voltages can be varied in order to control grey levels, but this duration must remain less than or equal to $t_{lig}$.

Other control processes are possible. For example, there is the control process using electric charges, more simply called the "charge control process" (see document [6]). A control process is also known using a current, more simply called "current control process" (see document [7]).

In the following, we will be interested in different control processes and more particularly the charge control process.

STATE OF PRIOR ART

The three control processes mentioned above do not provide a completely satisfactory solution for the control of electron sources with a matrix structure. It is usually necessary to have a uniform and quantified electronic emission that is achievable without major technical constraints.

Voltage control in these various processes to obtain grey levels is widely used since it is easy to implement. However, this assumes that the electrical response of the electron source is both stable and uniform. But these stability and uniformity conditions are difficult to achieve in known matrix structure electron sources. A high uniformity requirement for a screen leads to reject ratios that can be high. Similarly, there is a problem with differential ageing which, by destroying the uniformity of sources as a function of the degree to which a particular area of the source is used, deteriorates their real life.

Current control may appear to solve this problem since with current control, current is injected, and therefore a determined quantity of electrons. This principle is valid under static conditions. On the other hand, a capacitance charge problem occurs as soon as it is required to vary the electron source current quickly. A column electrode is comparable to a capacitor with respect to the rows through which the column passes and the current necessary for quickly charging this capacitor is several orders of magnitude higher than the emission current.

For example, in a field emission display with a definition of ¼ VGA and an area equal to 1 $dm^2$, the capacitance of a column with respect to the rows $C_{col}$ is equal to about 400 pF. If it is required to light a pixel, in other words to excite it, then the current passing through this pixel is varied from a value of almost 0 to a value of about 10 μA, and this is done by increasing the row-column voltage by about 40 V. If the switching is to be done in 1 μs (compared with the row time of 60 μs), the capacitive current is equal to:

$I=C_{col}\cdot dV/dt$, in other words about 16 mA.

Thus, the capacitive current is 1000 times greater than the emission current to be controlled. Obviously, this type of method is not suitable for fast control of a matrix source structure.

Charge control has already been proposed to solve this problem (see document [6]). FIG. 5 diagrammatically shows a display screen comprising an electron source with a matrix structure using charge control. The only difference between the screen shown in FIG. 5 and the screen shown in FIG. 4 is the means of applying control voltages to the source columns on the screen. In the case shown in FIG. 5, the means 42 of applying a control voltage to a column, for example $C_j$, comprise a logical module 44 into which a line synchro signal E1 is input, and a comparator 46 into which a set value A1 is input and which is connected to the logical module 44 as shown in FIG. 5. The voltage application means 42 also comprise a three-state output stage 48 that is also connected to the logical module 44 and into which voltages denoted $V_{c\text{-}on}$ and $V_{c\text{-}off}$ are input from voltage sources not shown. The three-state output stage and the comparator are connected to the corresponding column of the electron source ($C_j$ in the example considered).

In the case of a charge control, the column conductor considered is pre-charged so that source emissions are possible ($V_{c\text{-}on}$). The circuit is then opened to allow the column capacitor to discharge on its internal impedance, until the floating potential $V_{cj}$ reaches the set value A1 corresponding to the required electron quantity. The column is then adjusted to the extinguishing potential ($V_{c\text{-}off}$). This procedure would appear to be ideal, but requires the use of components that also need to be ideal and the implementation of such a method is actually difficult.

It was described above that a column electrode could be considered like a capacitor with regard to the rows of the matrix structure source, but there are also leakage currents that circulate between the column considered and the rows, and these currents vary with the potential difference between these electrodes. Consequently, when the circuit is opened, the voltage drop does not depend on the emission current alone, and it also depends on the leakage currents that vary themselves depending on this voltage drop.

More precisely, this potential variation is necessary to measure the charge collected in the self-capacitance of the column but this variation causes a problem. During the time $t_{lig}$, each of the columns will leak with respect to the selected row, but also with respect to all unselected rows. To simplify the problem, it is considered that this defect is comparable to an identical leakage resistance $R_{lc}$ for all pixels. This value represents the row/column leakage impedance for any one column. For a column and during the emission time, this leakage current $I_f$ is expressed as follows:

$$I_f = I_{f(ls)} + I_{f(lns)} = (V_{ls} - V_{cj}(t))/R_{lc} + (n-1).\ (V_{lns} - V_{cj}(t))/R_{lc}$$

where $I_f$=leakage current of a column with respect to all rows.

$I_{f(ls)}$=Leakage current of a column with respect to the selected row.

$I_{f(lns)}$=Leakage current of a column with respect to unselected rows.

$V_{ls}$=Potential applied to the selected row.

$V_{lns}$=Potential applied to unselected rows $V_{cj(t)}$=Floating potential of column j during the emission time.

n=Number of rows

To simplify matters, $V_{lns}$ can be assumed to be equal to 0 V, and since $V_{cj}$ (t) is very much less than $V_{ls}$, we obtain:

$$I_f=I_{f(ls)}+I_{f(lns)}$$

which is not very different from $$(V_{ls}/R_{lc})-(n-1)\cdot(V_{cj}(t)/R_{lc})$$

This imposes severe constraints on the values $R_{lc}$ of the different screen columns. Either leakage currents are negligible (such that the $R_{lc}$ values are high), or they are not completely negligible and in this case the minimum essential requirement is that these resistances $R_{lc}$ are very homogenous.

It can also be seen that a single pixel with an incorrect value of $R_{lc}$ imposes its leakage to the entire column considered through the term (n−1) in the formula given above.

In the example considered, the column voltage drop due to emission is equal to:

$\Delta V_{cj}=I\cdot t_{lig}/C_{col}$, such that if I=10 μA, $t_{lig}$=50 μs and $C_{col}$=400 pF, the result is $\Delta V_{cj}$=1.25 V.

Note that this variation $\Delta V_{cj}$ must be compared with the set value A1. This variation of the voltage $\Delta V_{cj}$ depends on the value of the capacitance of the column, which brings the technological variables for the screen (related to the dimensions of this screen) into the control circuit design parameters. In implementing it, it can also be seen that the comparator 46 is located at the output stage of the assembly forming the means of generating column control voltages. This means that this comparator must resist the entire voltage range necessary for control of the columns (about 40 V), or be able to isolate itself from this output by an additional stage.

PRESENTATION OF THE INVENTION

The purpose of this invention is to overcome the various disadvantages mentioned above.

Its purpose is a process for control of an electron source with a matrix structure, this source comprising at least one addressing row and at least one addressing column, the intersection of which defines at least one or several emission zones called pixels and in which the electrons are supplied by the column, this process being a sequential process characterized in that:

initially, the emission of electrons is triggered by the application of potentials on the selected row and the column(s), said potentials having a value that will enable this emission, and then the potential of the column(s) is maintained equal to this value throughout the duration of the emission, while the charge quantity emitted by the pixel(s) from the said column(s) is measured within the column(s) at the same time, and later, when the charge quantity measured on a column reaches a required charge quantity, the potential of this column is switched to a value that blocks emission of electrons.

According to one preferred embodiment of the process according to the invention, the value that will enable emission is equal to the potential of the unaddressed row(s).

Another purpose of the invention is a control device for an electron source with a matrix structure, this source comprising at least one addressing row and at least one addressing column, the intersection of which defines an area called a pixel and in which the electrons are supplied by the column, this device being characterized in that it comprises:

means of controlling the addressing row(s), said controlling means applying a selection potential on the selected row, and outside the selection time said controlling means leaving the row(s) at a potential that blocks emission of the corresponding pixels, means of controlling the column(s), these control means comprising, for each column, means of application, during a row selection, of either a first voltage to enable emission or a second voltage to block the said column, means of enabling a measurement in the column(s) of the quantity of charges emitted during emission, and holding at a constant level the voltage enabling emission from the said column during this measurement, and means of comparing the measured charge quantity with a reference charge quantity, with retroaction on the column control means.

According to a particular embodiment, the device according to the invention further comprises means for converting the charge quantity already emitted to a voltage level. The device according to the invention may also comprise means of compensating residual leakage currents.

This device may also comprise means of compensation of inter-column capacitive couplings.

BRIEF DESCRIPTION OF THE FIGURES

This invention will be better understood after reading the description of example embodiments given below purely for information purposes and in no way restrictive, with reference to the attached figures in which.

DETAILED PRESENTATION OF PARTICULAR EMBODIMENTS

Therefore, the charge control technique that was described above and that is also mentioned in document [6] is the main problem with variation of the potential of the controlled columns.

Consider the expression of the leakage current $I_{leak}$ as mentioned above:

$$I_{leak}=I_{leak\ ls}+I_{leak\ lns}=(V_{ls}-V_{cj\text{-}on}(t))/R_{lc}+(n-1)\ (V_{lns}-V_{cj\text{-}on}(t))/R_{lc} \quad (1)$$

This expression clearly demonstrates the leakage current component for the selected row and the leakage current component for the (n−1) unselected rows. The first of these components is inevitable since it is related to the basic principle of screen scanning. The second of these components may be cancelled provided that $V_{cj}$ (t) and $V_{lns}$ are both equal to the same constant.

This invention proposes a control circuit that operates under these conditions.

Figure 1:
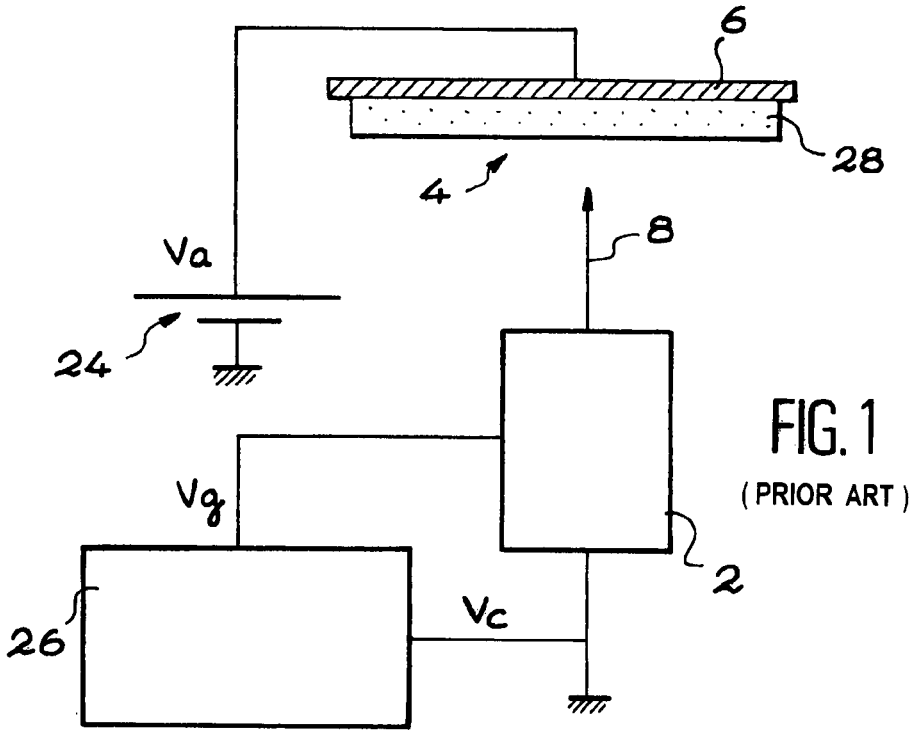
FIG. 1 (PRIOR ART)
FIG. 1 diagrammatically shows the operating principle of a display screen using a field emission device and has already been described.
Figure 2:
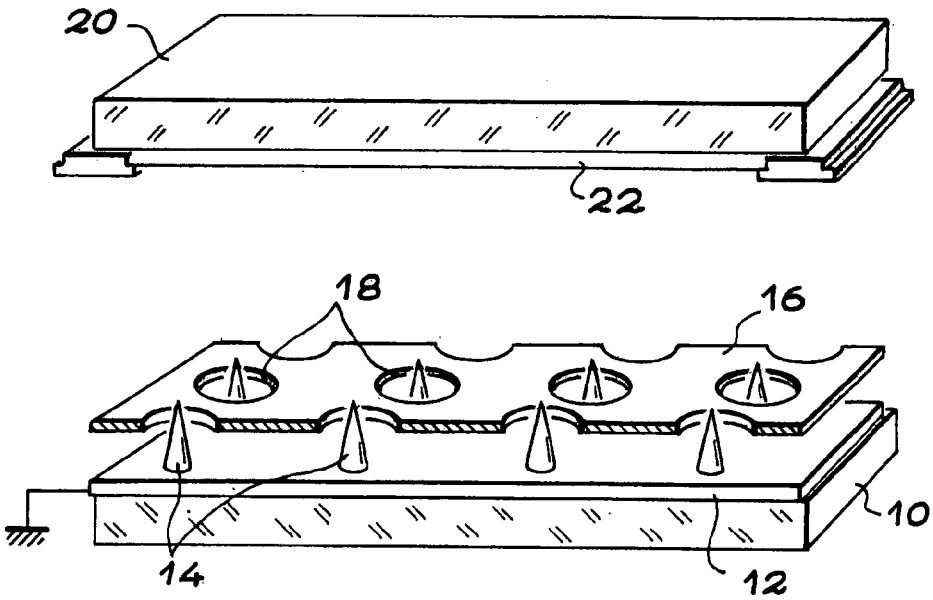
FIG. 2 (PRIOR ART)
FIG. 2 diagrammatically shows the structure of a microtip display and has already been described.
Figure 3:
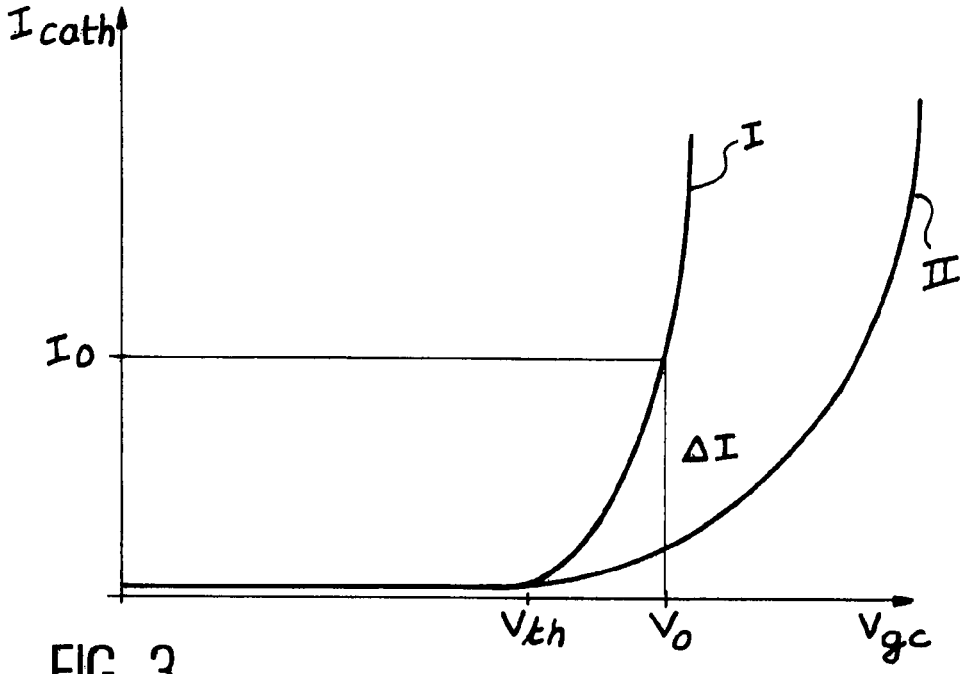
FIG. 3 (PRIOR ART)
FIG. 3 shows the characteristics Icath=f(Vgc) in the case of a triode type microtip display and has already been described.
Figure 4:
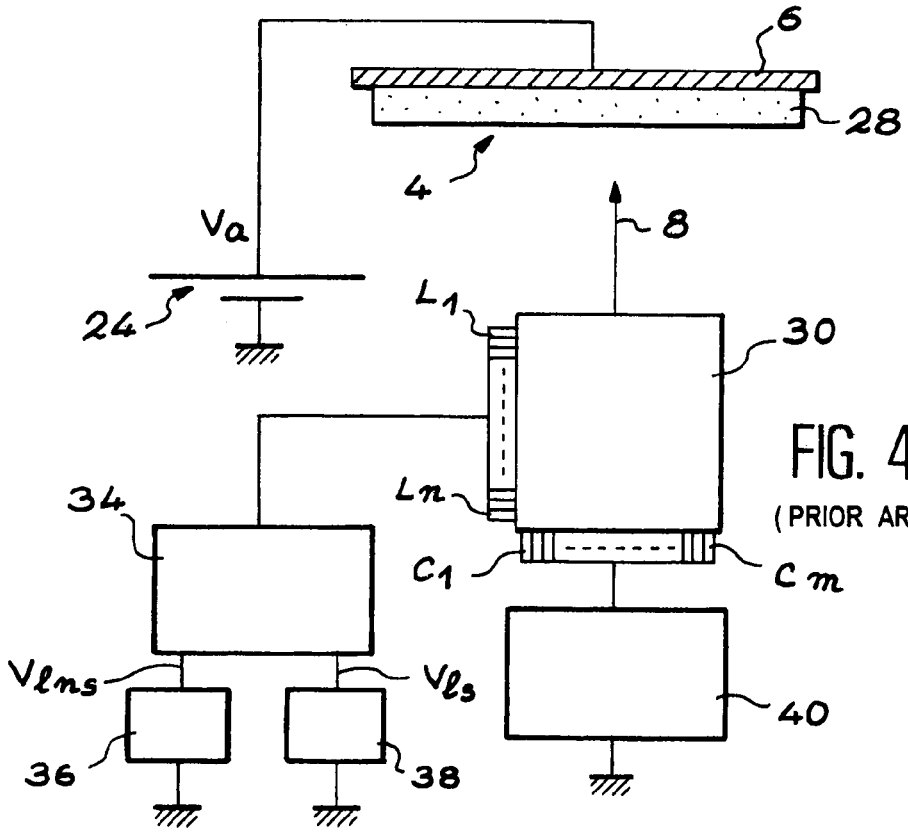
FIG. 4 (PRIOR ART)
FIG. 4 diagrammatically illustrates a display screen using a matrix structure field emission device and has already been described.
Figure 5:
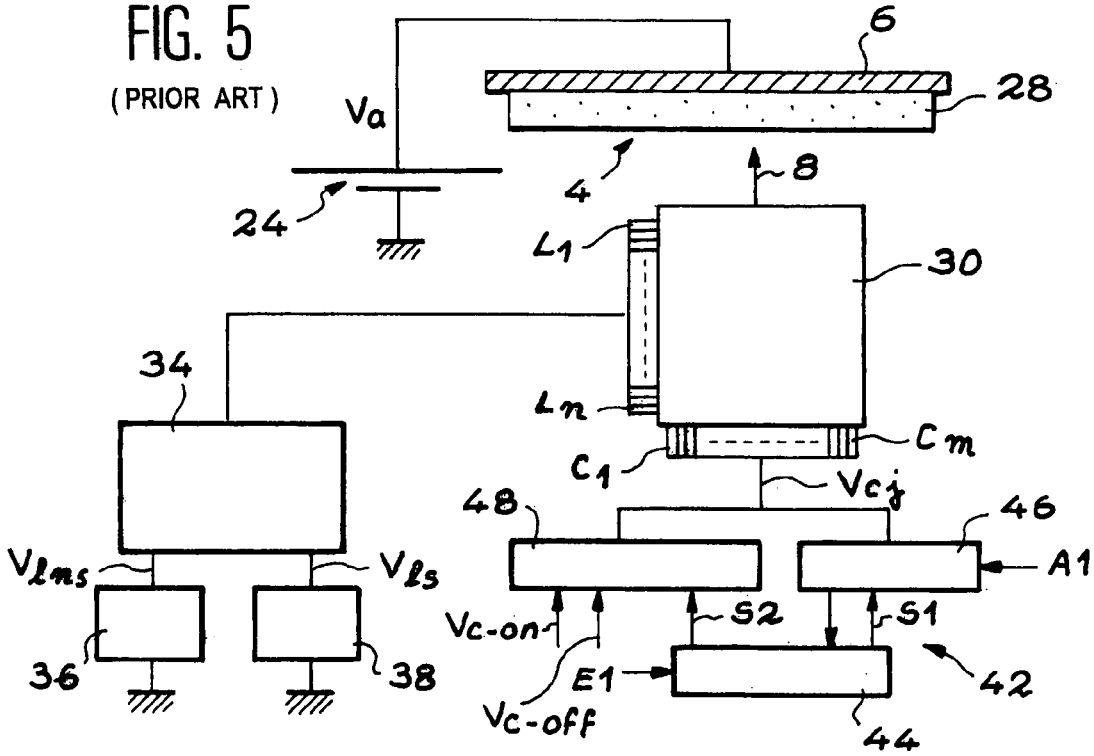
FIG. 5 (PRIOR ART)
FIG. 5 is a diagrammatic view of a known device for control of a matrix structure electron source and has already been described.
Figure 6:
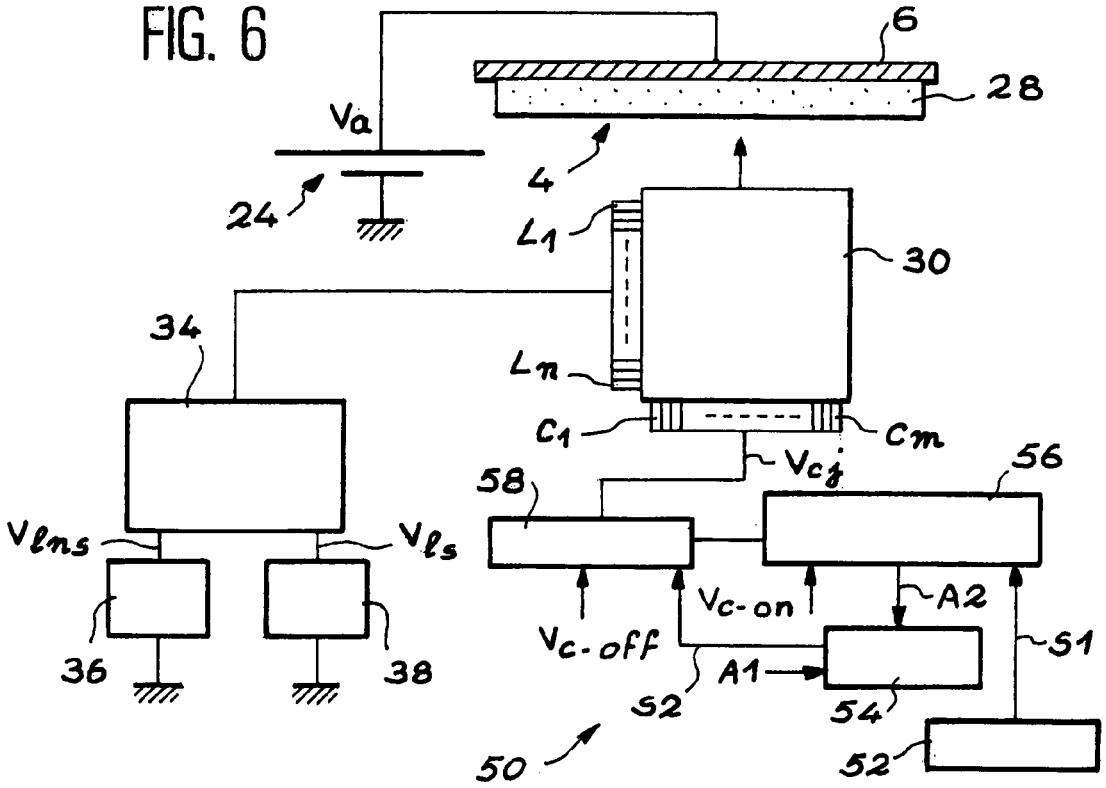
FIG. 6 is a diagrammatic view of a particular embodiment of the device according to the invention.

The above description mentioned the various functional modules necessary for charge control according to prior art (document [6]) in relation to FIG. 5. The different functional modules of a device according to the invention are shown diagrammatically in FIG. 6. In FIG. 6, reference 50 represents the control means for a screen column ($C_j$). As can be seen, these control means 50 comprise control logic 52, a comparator 54, a current integrator with control of $V_{col}$, and an output stage 58.

In this example of the invention, the following functions are carried out chronologically. The pixel on this column $C_j$ is initialized in emission ($V_{cj}=V_{c\text{-}on}$) using the output stage 58. The current supplied by the emitters is integrated while keeping the column potential stable at the value $V_{c\text{-}on}$. This is done using a functional module which will be described later. The result is then a voltage at A2 (see FIG. 6) that is proportional to the emitted charge. The emission of the pixel ($V_{cj}=V_{c\text{-}off}$) is cut off by the output stage 58 when the required charge selected by a value of the external set value A1, has been provided. In this operating mode, and during emission of the pixel considered, equation (1) becomes equation (2):

$$I_{leak}=I_{leak\ ls}+I_{leak\ lns}=(V_{ls}-V_{cj\text{-}on})/R_{lc}+(n-1)\times(V_{lns}-V_{cj\text{-}on})/R_{lc}$$

The voltage in the column has become fixed and $V_{cj\text{-}on}$ (t) and $V_{c\text{-}on}$ are both equal to the same constant value. The leakage term for the (n−1) rows can then be cancelled by choosing $V_{c\text{-}on}$ equal to $V_{lns}$. For simplification reasons, these two potentials are defined as being equal to the ground reference for the entire device. The result is than:

$$I_{leak}=I_{leak\ ls}=V_{ls}/R_{lc} \quad (3)$$

The advantage of the control process used in this example of the invention can then be seen immediately, even if there is still a leakage current, this leakage current then only depends on the addressed pixel and no longer on the (n−1) other unaddressed pixels in the same column. In other words, the addressing process used in this example of the invention can give a better image quality for the same screen (in terms of the resistance $R_{lc}$).

Under these conditions, it is possible to compensate for the residual current since this current is constant because the voltage $V_{ls}$ is fixed. Therefore, a current with the opposite sign can be injected on each column during each row time.

Therefore the invention relates to a sequential process for the control of an electron source, in order to:

keep the potential of the columns equal to the potential of the unaddressed rows, and simultaneously measuring the charge quantity emitted by the pixels from these columns, throughout the duration of the emission, return the column potential to a level that blocks the emission when the measured charge quantity becomes equal to the required charge quantity.

Figure 7:
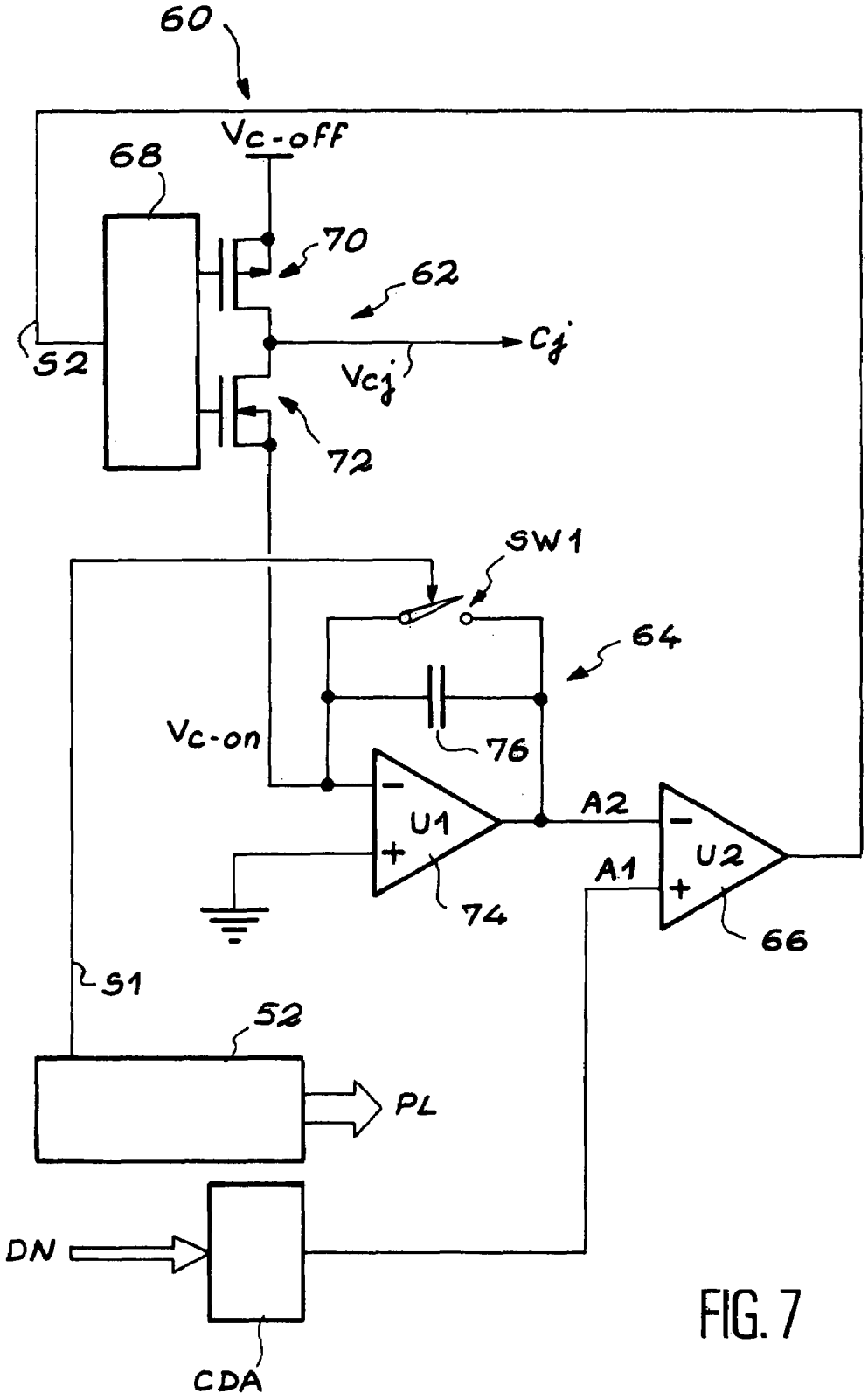
FIG. 7 diagrammatically shows an example of a control device for one column in a device according to the invention.

We will now consider an example control device for a column according to the invention shown in FIG. 7.

This control device 60 comprises a push-pull type output state 62, a current integrating circuit 64 and a comparator 66.

The output stage 62 is used to switch either the power supply voltage $V_{c\text{-}off}$ corresponding to the level at which the pixel goes off, or the input to the integrator circuit 64 that imposes the level $V_{c\text{-}on}$ by its virtual ground (putting it at the same potential as the unselected rows), on the column electrode ($C_j$). The output stage 62 comprises known means 68 of translating the logical level and two MOSFET transistors 70 and 72. The transistor 70 is of the P type and the transistor 72 is of the N type, and these means 68 and its transistors are arranged as shown in FIG. 7.

The integrating circuit 64 comprises an amplifier 74 that is looped back onto a capacitor 76 with a capacitance $C_{int}$ that is itself installed in parallel with a controlled switch SW1, the output A2 from this amplifier being connected to the input (−) of the comparator 66.

The controlled switch brings the potential A2 at the beginning of each row to zero.

The comparator (+) input is connected to a set voltage A1 corresponding to the quantity of charges to be emitted. In this invention, this set voltage may be supplied by various means that depend on the required application of the invention. In the example shown in FIG. 7, a digital analog converter DAC is used that receives a digital set voltage data DN as input, and which supplies the set potential A1 as output.

The output S2 from the comparator circuit controls the push-pull output stage so that the device has feedback.

The signal S1 (corresponding to the start of the time allocated to a row) according to a chronology that will be described later, controls switch SW1. It can be seen that the control logic S2 that supplies S1, also controls a row control circuit PL not shown.

Figure 8:
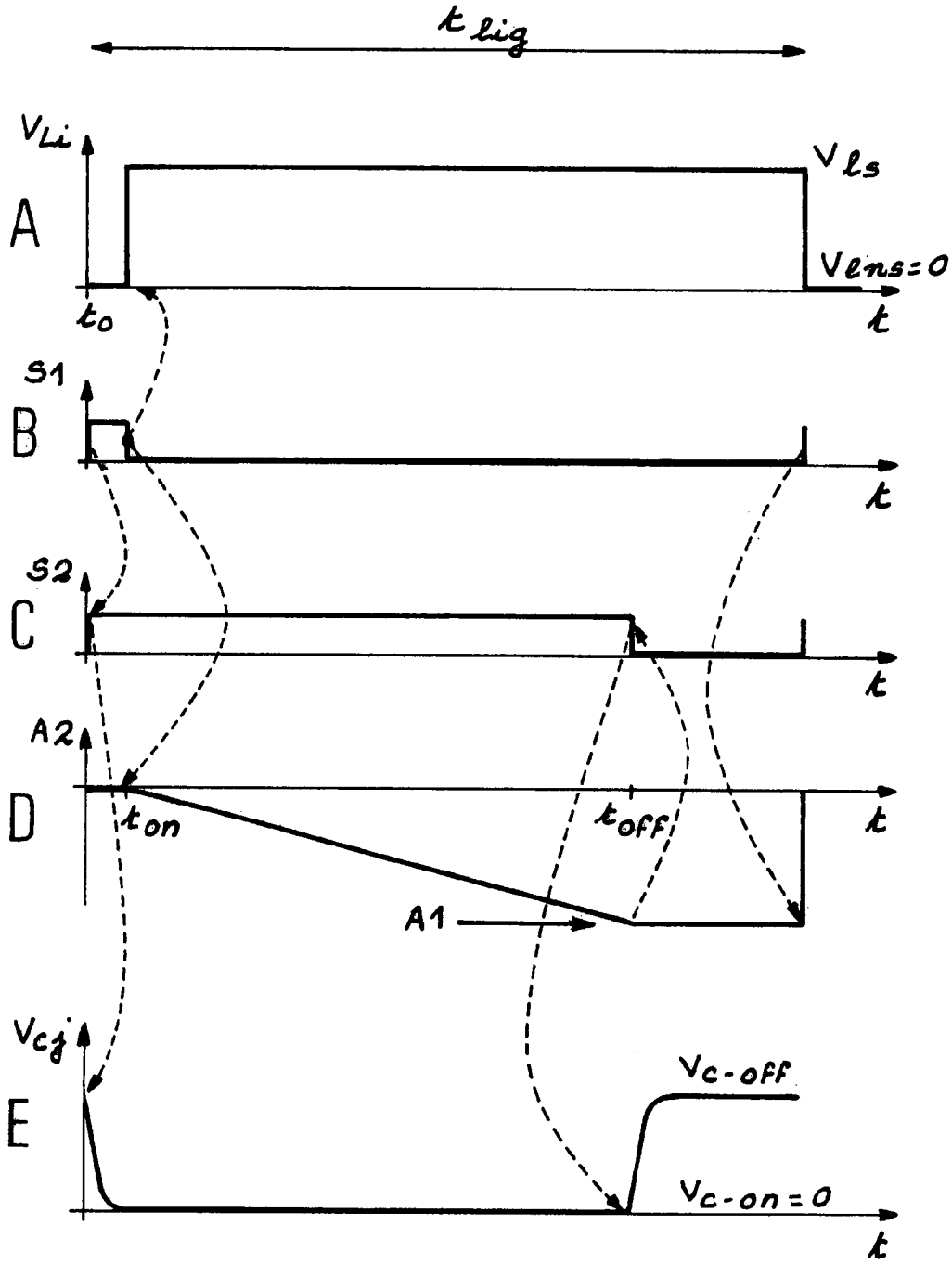
FIG. 8 is a time diagram showing the different voltages used in the device in FIG. 7.

FIG. 8 shows the time diagram for the different voltages within the device during a row addressing cycle. The cycle (see FIG. 8 part A) starts at time $t_0$ by a signal start pulse S1 (see FIG. 8 part B), triggering the rise of S2 (see FIG. 8 part C) which changes from column $V_{cj}$ to $V_{c\text{-}on}$ (virtual ground), through the output stage. After a time during which $V_{cj}$ becomes equal to voltage $V_{c\text{-}on}$ (time $t_{on}$), the signal S1 changes to the low level to open switch SW1, which begins current integration in $C_{int}$. The emission is started by $V_{Li}$ setting its potential $V_{lns}$ (defined as being the circuit ground) to the selection potential $V_{ls}$, the U1 and $C_{int}$ assembly are then charged at A2 (see FIG. 8 part D), according to the following equation:

$$A2=-I\times t/C_{int}.$$

When potential A2 reaches the set potential A1, the comparator U2 switches to its output S2 (S2 drops) which, forces $V_{cj}$ to return to $V_{c\text{-}off}$, through the output stage (see FIG. 8 part B), at time $t=t_{off}$ such that:

$$Q=I\cdot(t_{off}-t_{on})=C_{int}\times A1.$$

Therefore, it can be seen that the described device can output a charge to the pixel considered controlled by the supplied set value A1, without varying the voltage applied on the column during the emission time.

It will be noted that the row potential $V_{Li}$ is switched to the selection potential $V_{ls}$ after the potential of column ($V_{cj}$) has been set up, in order to reduce the capacitance to be charged to make it equal to the capacitance of the pixel considered alone. Therefore the capacitive current in the column will been minimized.

If the potential $V_{Li}$ increases before $t_{on}$, the emission current is set up before the beginning of the integration (and therefore the corresponding charges will not be measured). If $V_{Li}$ increases during or after the beginning of the integration ($t_{on}$), the charges corresponding to the pixel capacitive current are measured and create an initial voltage offset on A2. Therefore, a small phase difference between when $V_{Li}$ increases and the descending front of S1 may be adjusted to adopt the best compromise depending on the application.

To avoid switching a column that should be displayed in black to $V_{c\text{-}on}$ for no reason, it will be noted that this level can be managed directly by the control logic by keeping signal S1 for the corresponding column at the low level.

Figure 9:
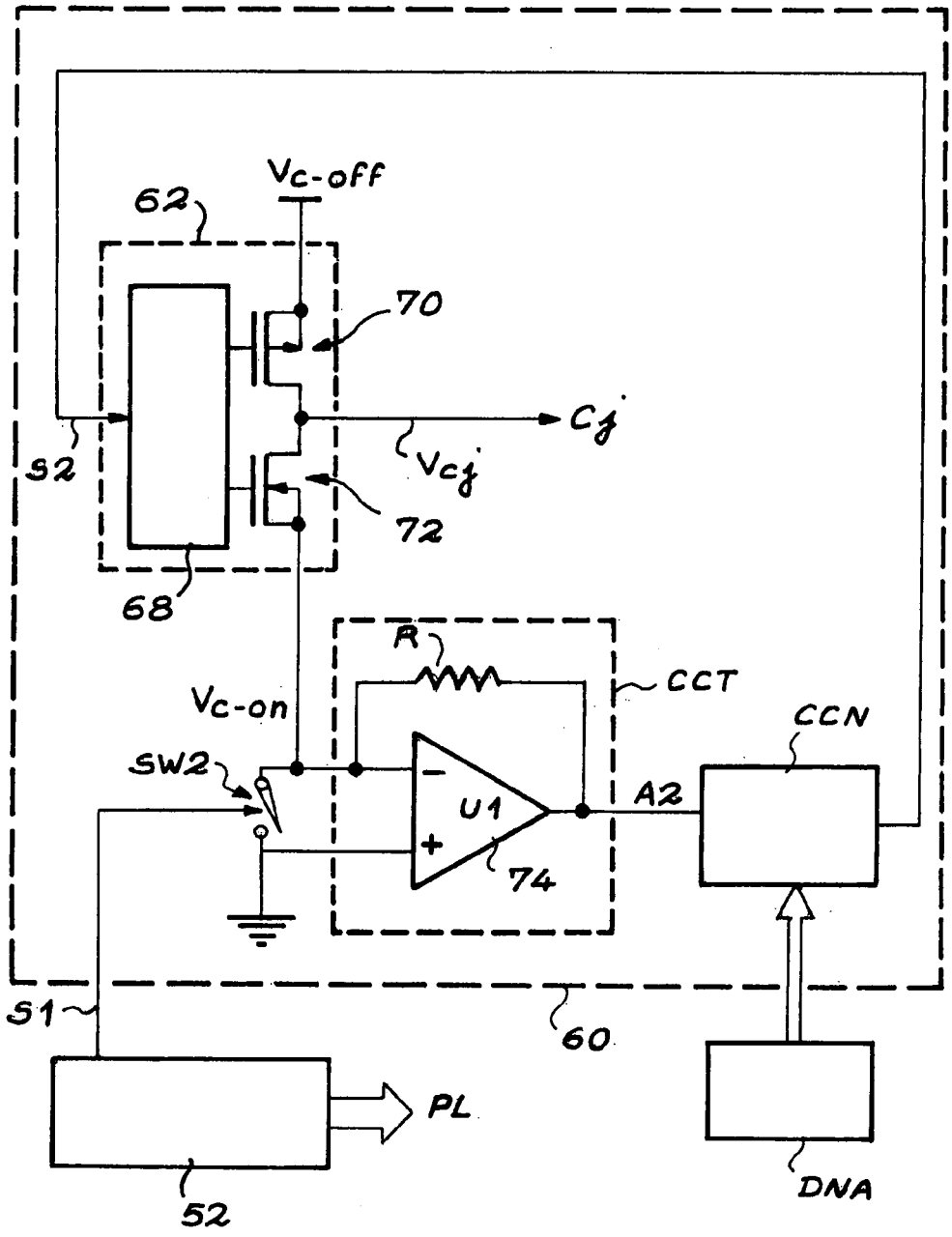
FIG. 9 diagrammatically shows a variant of FIG. 7.

Another example embodiment of a control device for a column according to the invention is shown diagrammatically in FIG. 9. This is a variant of FIG. 7.

In summary, the previous system FIG. 7) converts the charge quantity already emitted into a voltage level, which changes the control of the column control stage at time $t_{off}$, when the set charge quantity ($Q_{ref}$) has been reached.

A similar result can be obtained using a current-voltage converter CCT type circuit. The current ($I_j$) is stable throughout the row time, and the instantaneous measurement of this current associated with a digital or analogue calculation circuit CCN, is used to calculate the column switching time $t_{off}$, such that $t_{off}=Q_{ref}/I_j$, at the beginning of the row time.

This solution is shown in FIG. 9. In this figure, the switch SW2 evacuates currents directly to the ground, except at the time of the measurement. High capacitive currents could disturb the current voltage converter CC2 during row/column switching.

FIG. 9 shows that the converter CCT comprises the amplifier 74 already used in the example in FIG. 7, but in the case of FIG. 9 it is associated with a resistance R installed between the input (−) and the output of amplifier 74.

It can also be seen that the circuit CCN receives digital or analog data from appropriate means DNA.

We will now consider compensation of residual leakage currents.

Figure 10:
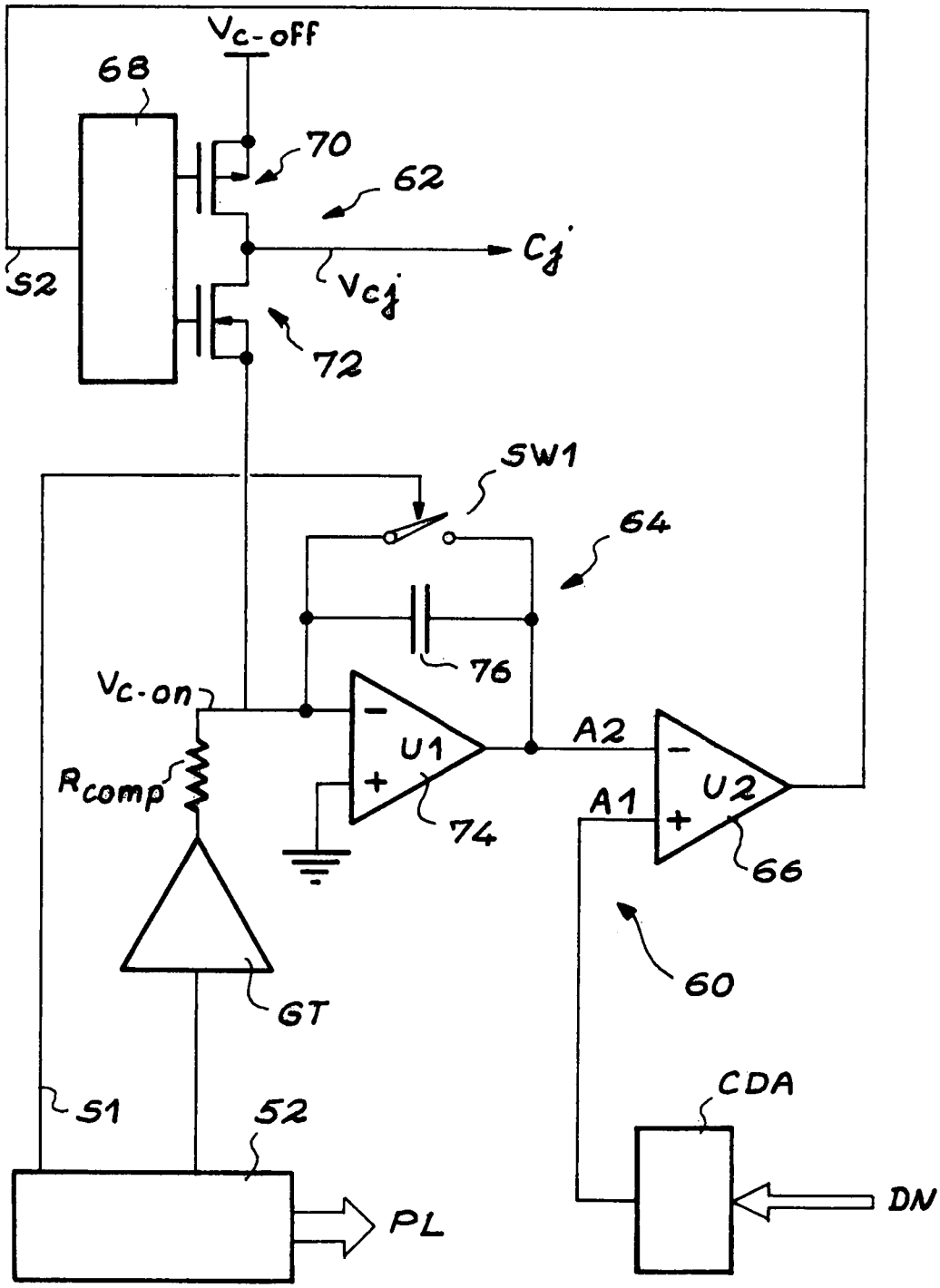
FIG. 10 diagrammatically shows an example of a device for control of a column with leakage current compensation, in a device according to the invention.

To inject a compensation current with sign opposite to $I_{leak\ ls}$ on each column and during each row time, a current source is connected to the integrator measurement input (see FIGS. 6 and 7). For example, this connection may consist of a transistor installed as a current generator or a resistance $R_{comp}$ controlled by a variable voltage generator GT, as shown in FIG. 10.

We will now consider another aspect of the invention related to compensation of inter-column capacitive couplings.

Figure 11:
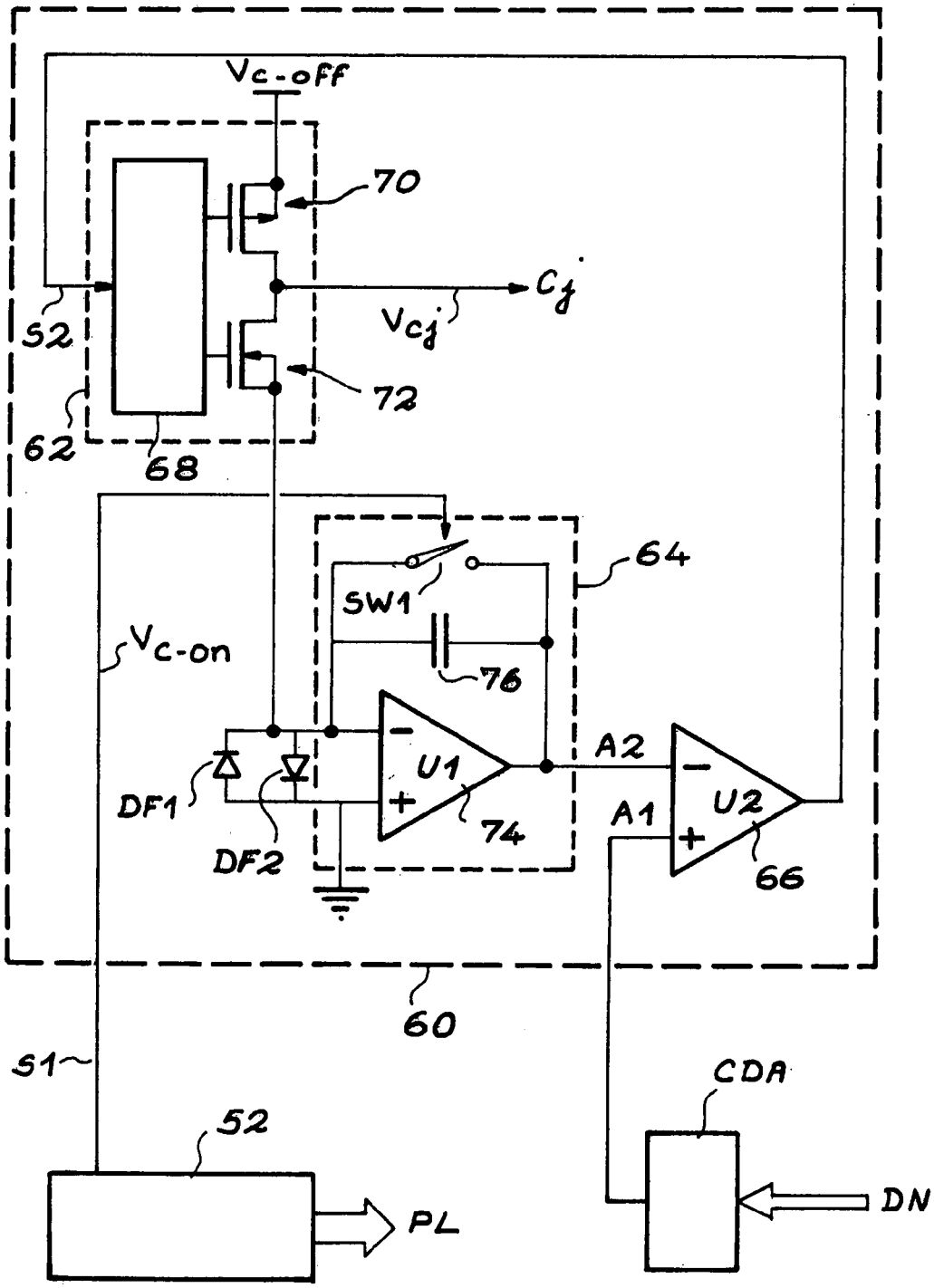
FIG. 11 diagrammatically shows an example embodiment of a control device for a column with the use of diodes to filter parasite charges due to inter-column capacitances, according to the invention.

When the potential of any column j is switched from $V_{c\text{-}on}$ to $V_{c\text{-}off}$, a parasite charge $Q_{par}=C_{par}(V_{c\text{-}on}-V_{c\text{-}off})$, where $C_{par}$ is the inter-column coupling capacitance, is induced on the adjacent column (j−1) or (j+1). If columns (j−1) or (j+1) are still in emission at this moment, this charge $Q_{par}$ will then be measured by the integrators located on these columns, this distorting the measurement of the charge emitted by the pixels in the said columns. Since this charge $Q_{par}$ is constant for a given screen size, several solutions are possible to solve this problem. These solutions can be combined with each other to achieve the specifications for the required number of grey shades. Two main classes of solutions could be considered, apart from technological improvements to reduce the capacitance $C_{par}$:

I) Prevent the charge $Q_{par}$ from being measured by the charge integrator, which requires analog filtering solutions to be set up on the input side of this integrator:

FIG. 11 shows an example of the use of diodes to filter parasite charges due to inter-column capacitances. This is an asynchronous solution based on fast switching diodes, that respond much faster than the integrator. In other words, the fact that variations of capacitive currents take place quickly compared with variations of the emission current is used, these variations being practically zero under steady state conditions during the row time. Similarly, it would be possible to use analogue or logical filters to discriminate between emission currents and parasite capacitive currents.

In the example in FIG. 11, two filter diodes DF1 and DF2 are used to filter parasite charges due to inter-column capacitances.

Figure 12:
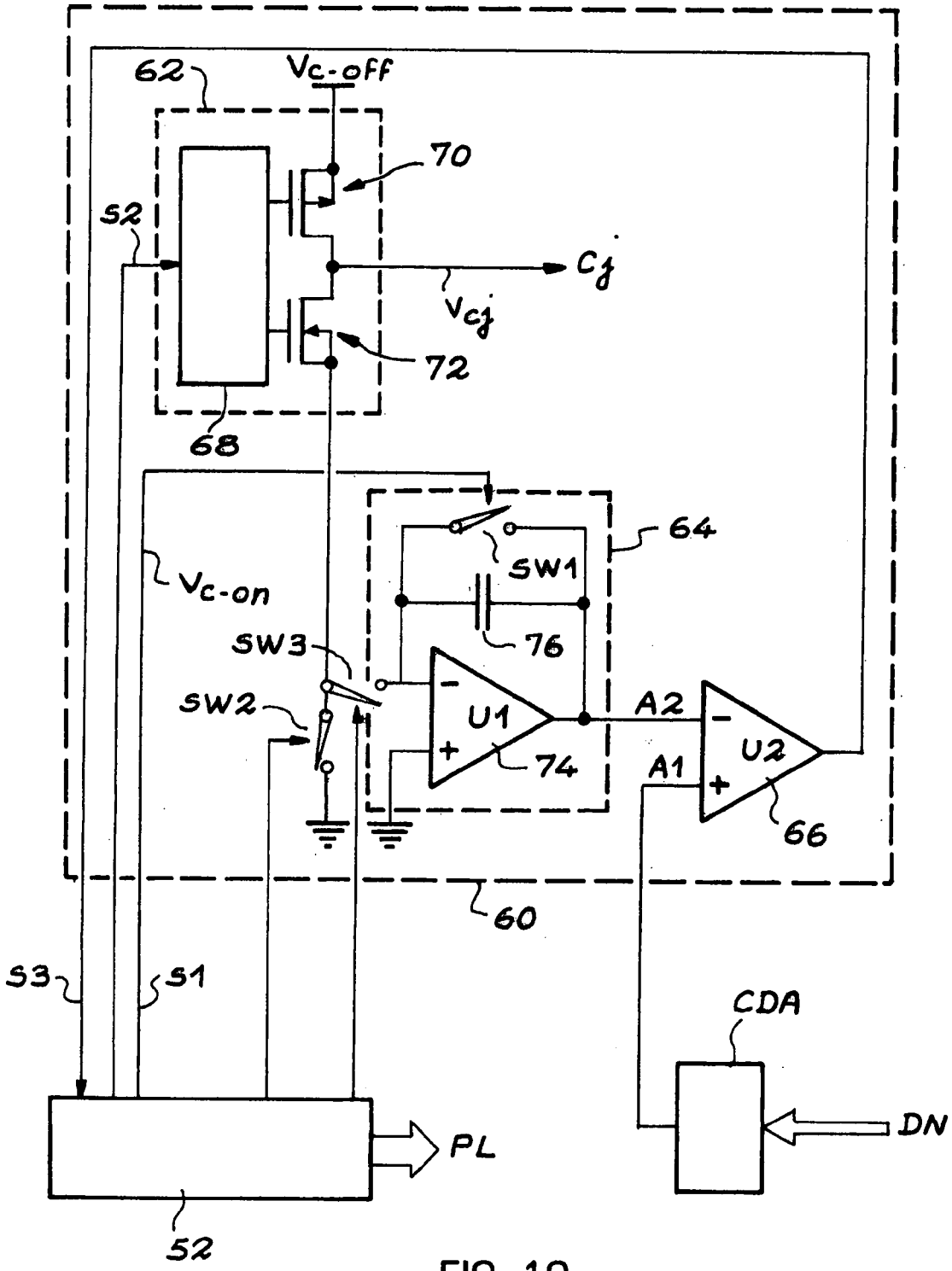
FIG. 12 diagrammatically shows an example embodiment of a control device for a column with the use of transistors to filter parasite charges due to inter-column capacitances, according to the invention, and FIG. 13 diagrammatically illustrates an example embodiment of a control device for a column with the use of analogue compensation for parasite charges due to inter-column capacitances, according to the invention.

FIG. 12 shows another example embodiment of a control device for a column including filtering of parasite charges due to inter-column capacitances, this time by transistors. This is a synchronous type of solution. In this case, the comparator output is revalidated by the logic to supply S2 at precise instants. The instants at which columns are switched from $V_{c\text{-}on}$ to $V_{c\text{-}off}$ are then fixed. Therefore, it is possible to synchronously prevent the capacitive currents associated with this consumption from being integrated into the charge measurement. In the example in FIG. 12, all that is necessary is to close SW2 and open SW3 synchronously with S2, for all columns. After a minimum time necessary for the dissipation of capacitive currents (if the adjacent column(s) is (are) switched), the standard measurement mode is resumed by switching to SW2 open and SW3 closed. The operating frequency ($F_{sw}$) of switches SW2, SW3 must be fast enough to be compatible with the required number of grey shades ($N_{grey}$). The condition $F_{sw}>N_{grey}\cdot F_{row}$ must be respected, where $F_{row}$ is the addressing frequency of the screen rows.

Figure 13:
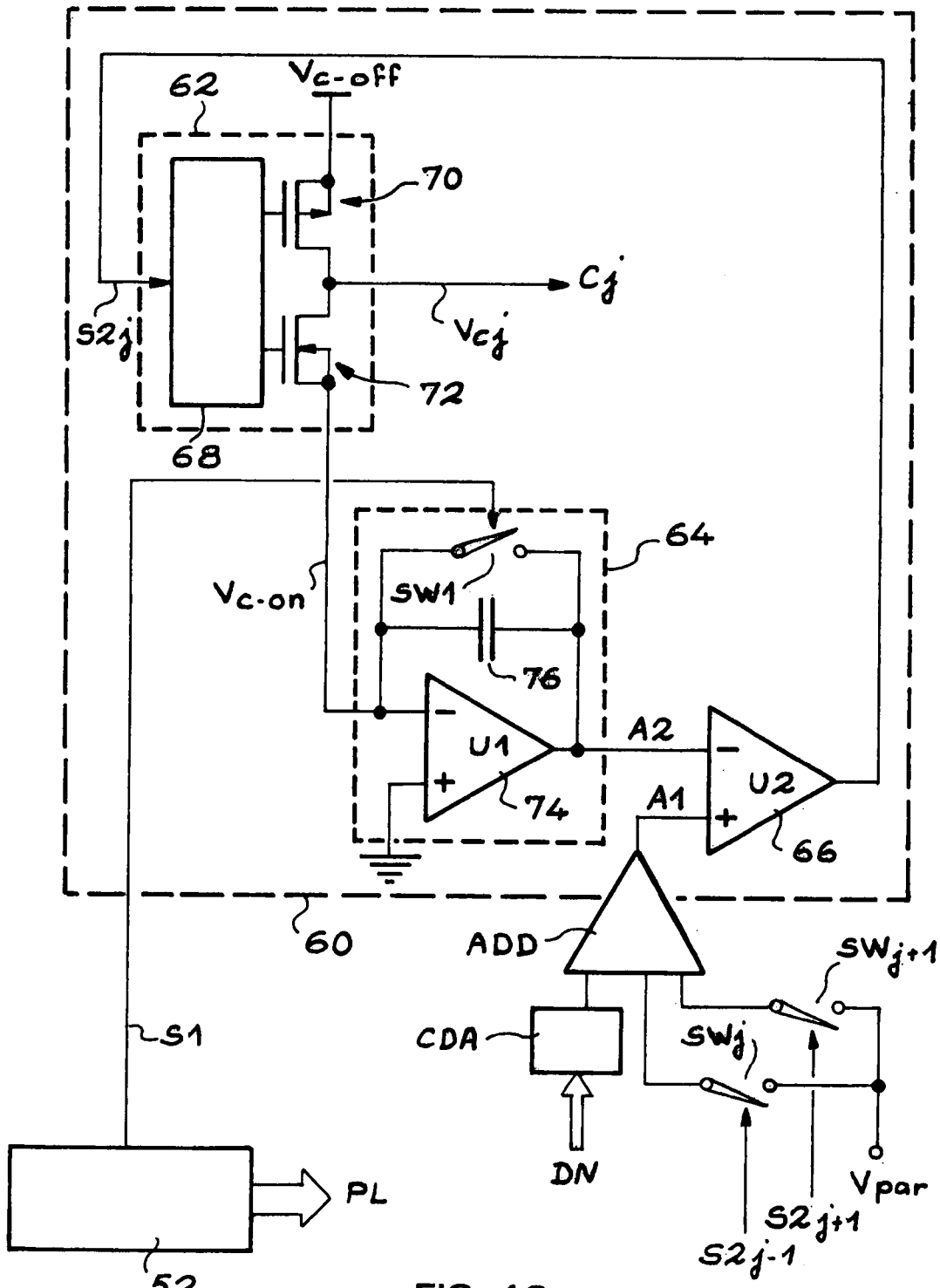

II) Compensate this charge $Q_{par}$ (since it is a fixed charge) so that analog or digital type solutions can be used on the output side of the integrator:

FIG. 13 presents an example embodiment of a column control device with analog compensation of parasite charges due to inter-column capacitances of adjacent columns. It can be seen that for an arbitrary column j, the signals switching columns j−1 and j+1 to $V_{c\text{-}off}$ can be used to readjust the set value A1 by a quantity $V_{par}=(Q_{par})/C_{int}$, using an adder. Obviously, this addition can be made digitally of the input side of the digital analog converter CDA.

In the example in FIG. 13, the adder is marked with the reference ADD. The references of the switching signals for columns j−1 and j+1 are $S2_{j-1}$ and $S2_{j+1}$ respectively.

It can be seen that these signals control the corresponding switches $SW_j$ and $SW_{j+1}$ connected to the adder ADD as shown in FIG. 13.

We will now mention the various advantages provided by the invention.

In summary, the control method proposed in this invention consists of a column control, under a constant voltage, of a pulse width modulation (PWM) type, the pulse width being controlled by the emitted charge. This type of column control circuit, for which an advantageous embodiment has just been described, has many advantages:

- a limitation of column leakage currents, to be equal to the leakage currents for the addressed line only, which can give a better image quality in terms of uniformity for a given screen,
- stabilization on the row time of this residual leakage current, which becomes independent of the quantity of charges to be emitted by the pixel considered,
- still for this leakage current, its effect in the current integrator circuit becomes linear with time, which can simplify compensations of this leakage current,
- unlike the charge control according to prior art, this control mode maintains a constant column voltage throughout the emission, which therefore means that the emission from the pixel can remain at the maximum, and therefore the brightness can be maximum, for a given row time,
- the proposed control circuit is "independent" of the technological and dimensional characteristics of the screen,
- in terms of voltages, the control circuit completely decouples emitted charge measurement functions (integrator plus comparator) from output stage functions. For example, it would be possible to imagine measurement functions operating at 5 volts, while the potentials of columns switched by the output stage are equal to several tens of volts.

The following documents are mentioned in this description:

[1] *Ecrans fluorescents à micropointes* (Fluorescent field emission displays), R. Baptist, *L'onde électrique,* November-December 1991, vol. 71, No. 6, pp. 36-42.

[2] Flat panel displays based on surface-conduction electron emitters, K. Sakai et al., Proceedings of the 16th international display research conference, ref.18.3L., pp. 569-572.

[3] Carbon nanotube FED elements, S. Uemura et al., SID 1998 Digest, pp. 1052-1055.

[4] Recent progress in field emitter array development for high performance applications, Dorota Temple, Materials science & engineering, vol. R24, No. 5, January 1999, pp. 185-239.

[5] Microtips displays addressing, T. Leroux et al., SID 91 Digest, pp. 437-439.

[6] FR 2632436 A, Procédé d'adressage d'un écran matriciel fluorescent à micropointes (Addressing process for fluorescent field emission display), invention by J-F Clerc and A. Ghis, corresponding to EP 0345148 A and U.S. Pat. No. 5,138,308 A.

[7] U.S. Pat. No. 5,359,256A. Regulatable field emitter device and method of production thereof, H. F. Gray.

Returning to this invention, charge control circuits to make electron sources function are described in documents WO 96 05589 and U.S. Pat. No. 6,020,864. These circuits apply voltages on rows and columns of a matrix source to enable emission of electrons and to measure the charge quantity emitted to compare it with a set value.

The fundamental difference between these known techniques and this invention is due to the fact that with these known techniques, the charge measurement takes place at the "anode side" where the high voltage is set up (a few kV), whereas in the invention it is done at the "cathode side" in other words on the low voltage side (at a few tens of volts), at the same time as the emission.

The charge is usually measured on a resistance which causes a variation of the voltage of the order of 1 V, considering the other magnitudes involved. This measurement voltage disturbs the power supply circuit; in prior art, a variation of 1 volt with respect to the applied several kilovolts provokes a negligible error. With the invention, the error would become very large (1 volt compared with the several tens of volts) and would be absolutely unacceptable.

Therefore the measurement techniques described in the documents mentioned above are unusable at the "cathode side". The problem that arises is solved by this invention.

The invention claimed is:

1. Process for control of an electron source with a matrix structure, this source comprising at least one addressing row and at least one addressing column, the intersection of which defines one or several emission zones called pixels and in which the electrons are supplied by the column, this process being a sequential process characterized in that:

initially, the emission of electrons is triggered by the application of potentials on the selected row and the column(s), said potential having a value that will enable this emission, and then the potential of the column(s) is maintained equal to this value throughout the duration of the emission, while the charge quantity emitted by the pixel(s) from the said column(s) is measured within the column(s) at the same time, and later, when the charge quantity measured on a column reaches a required charge quantity, the potential of this column is switched to a value that blocks emission of electrons.

2. Process according to claim 1, in which the said value that enables the emission is equal to the potential of the unaddressed row(s).

3. Control device for an electron source with a matrix structure, this source comprising at least one addressing row and at least one addressing column, the intersection of which defines an area called a pixel and in which the electrons are supplied by the column, this device being characterized in that it comprises:

means of controlling the addressing row(s), said controlling means applying a selection potential on the selected row, and outside the selection time said controlling means leaving the row(s) at a potential that blocks emission of the corresponding pixels, means of controlling the column(s), these control means comprising, for each column, means of application, during a row selection, of either a first voltage to enable emission or a second voltage to block the said column, means of enabling a measurement in the column(s) of the quantity of charges emitted during emission, and holding at a constant level the voltage enabling emission from the said column during this measurement, and means of comparing the measured charge quantity with a reference charge quantity, with retroaction on the column control means.

4. Device according to claim 3, further comprising means for converting the charge quantity already emitted into a voltage level.

5. Device according to claim 3, also comprising residual leakage current compensation means.

6. Device according to claim 3, also comprising means of compensation for inter-column capacitive couplings.

* * * * *